US011257379B2

(12) United States Patent
Shamasundar et al.

(10) Patent No.: US 11,257,379 B2
(45) Date of Patent: Feb. 22, 2022

(54) EMULATING A VEHICLE-COMMUNICATIONS-CENTER DATA REQUEST TO OBTAIN DATA FROM A SYSTEM OR SUBSYSTEM ONBOARD THE VEHICLE

(71) Applicant: Honeywell International Inc., Morris Plains, NJ (US)

(72) Inventors: Raghu Shamasundar, Bangalore (IN); Thomas D. Judd, Woodinville, WA (US); Yi Zhong, Shanghai (CN); Sundaresh Seethahally Krishnamurthy, Bangalore (IN); Lei Xie, Shanghai (CN)

(73) Assignee: Honeywell International Inc., Charlotte, NC (US)

( * ) Notice: Subject to any disclaimer, the term of this patent is extended or adjusted under 35 U.S.C. 154(b) by 273 days.

(21) Appl. No.: 16/370,374

(22) Filed: Mar. 29, 2019

(65) Prior Publication Data

US 2020/0312158 A1 Oct. 1, 2020

(51) Int. Cl.
*G08G 5/00* (2006.01)

(52) U.S. Cl.
CPC ..... *G08G 5/0013* (2013.01); *G08G 5/003* (2013.01)

(58) Field of Classification Search
CPC ..... G08G 5/0013
See application file for complete search history.

(56) References Cited

U.S. PATENT DOCUMENTS

| | | | | |
|---|---|---|---|---|
| 7,908,042 | B2 | 3/2011 | Brinkley et al. | |
| 8,280,563 | B2 | 10/2012 | McGuffin et al. | |
| 8,600,675 | B1 | 12/2013 | Borghese et al. | |
| 8,983,686 | B2 * | 3/2015 | Broquet | G05B 23/0272 701/14 |
| 9,557,189 | B2 * | 1/2017 | Cornell | G08G 5/0004 |
| 9,913,199 | B1 * | 3/2018 | Bolling | H04B 7/18506 |
| 10,798,033 | B2 * | 10/2020 | Judd | H04L 51/046 |

(Continued)

OTHER PUBLICATIONS

European Patent Office, "Extended European Search Report from EP Application No. 20165403.5", from Foreign Counterpart to U.S. Appl. No. 16/370,374, filed Sep. 7, 2020, pp. 1 through 8, Published: EP.

*Primary Examiner* — Alex C Dunn
(74) *Attorney, Agent, or Firm* — Fogg & Powers LLC

(57) ABSTRACT

An embodiment of a communication management unit (CMU) includes emulator and data-mining circuits. The emulator circuit is configured to generate a data request having a same format as a data request from a vehicle communications center, to send the data request to a subsystem disposed on a vehicle, and to receive data sent by the subsystem in response to the data request. The data-mining circuit is configured to provide at least some of the received data to a determining circuit configured to determine information in response to the provided data. For example, such a CMU can request flight-plan data from a flight management subsystem (FMS) by sending, to the FMS, an emulated data-request message having the same format as a data-request message from a ground-based aircraft operations center. That is, the CMU can "fool" the FMS into "thinking" that the data-request message originated from the ground-based aircraft operations center.

19 Claims, 4 Drawing Sheets

(56) References Cited

U.S. PATENT DOCUMENTS

| | | | | |
|---|---|---|---|---|
| 2013/0028174 | A1* | 1/2013 | Cabos | H04L 51/063 370/316 |
| 2016/0290827 | A1* | 10/2016 | Cornell | G01C 23/005 |
| 2017/0289309 | A1 | 10/2017 | Judd et al. | |
| 2018/0048674 | A1* | 2/2018 | Black | H04W 12/03 |
| 2018/0287971 | A1* | 10/2018 | Judd | H04B 7/18506 |
| 2019/0208386 | A1* | 7/2019 | Flasher | H04L 67/12 |
| 2020/0013293 | A1* | 1/2020 | Maji | G08G 5/0039 |
| 2020/0365039 | A1* | 11/2020 | Yamada | G08G 5/04 |

* cited by examiner

EMULATING A VEHICLE-COMMUNICATIONS-CENTER DATA REQUEST TO OBTAIN DATA FROM A SYSTEM OR SUBSYSTEM ONBOARD THE VEHICLE

SUMMARY

FIG. 1 is a diagram of a ground-based air traffic control (ATC) 10 center, a ground-based aircraft operations center (AOC) 12, and an aircraft 14 in flight. Although described as being a ground-based aircrafts operation center, the aircraft operation center 12 can be located anywhere such that it is remote, or otherwise separate, from the aircraft 14.

Each of the ground-based ATC 10 and the ground-based aircrafts operations center 12 can include one or more computing circuits, such as microprocessors or microcontrollers, that can be configured with firmware or other configuration data, programmed with software, or hardwired to perform certain functions and tasks related to the flying, monitoring, and maintenance of the aircraft 14.

The aircraft 14 includes one or more electronic subsystems 16, such as a flight management computer (FMC, hereinafter called a flight management system (FMS)), central maintenance computer (CMC), and an aircraft condition monitor (ACM), a communication management unit (CMU) 18, and one or more data busses 20, for example, an Aeronautical Radio INC. (ARINC) 429 bus, over which the CMU and the other one or more subsystems are configured to communicate with one another (other examples of the one or more busses 20 include an avionics full-duplex switched Ethernet (AFDX), a back-plane bus, and Ethernet). Each of the electronic subsystems 16 and the CMU 18 can include one or more respective computing circuits, such as a microprocessor or microcontroller, and respective other circuits, such as peripheral circuits and sensors. The computing circuits and other circuits can be configured with firmware or other configuration data, programmed with software, or hardwired to perform certain functions and tasks related to the flying, monitoring, flight-application processing, and maintenance of the aircraft 14. For example, each of one or more of the computing circuits can execute one or more software applications to implement the functions of the corresponding subsystem.

Although not shown in FIG. 1, the CMU 18 includes an AOC data engine, which is configurable by a loadable AOC database (not shown in FIG. 1), and which provides the CMU with the ability to communicate with systems, subsystems, and human/machine interfaces (both onboard and off board the aircraft 30) including the aircraft operations center 12; hereinafter, the CMU is referred to as the "CMU" or the "CMU AOC." Because the CMU 18 is database configurable, an airline can configure the CMU to perform custom communication functions and operations without going to the trouble of requesting the aircraft manufacturer to re-certify the CMU software. For example, an airline can configure the AOC data engine such that the CMU 18 defines a message that includes available data (e.g., flight-status data) or a value that the CMU, or other system or subsystem, calculates from the available data, sends the message to a pilot via a computer display in the cockpit, and allows the pilot to review, and to forward selectively, the information to, e.g., ATC 10 or the aircraft operations center 12, via a cockpit human-machine-interface (HMI) device (e.g., a device, such as a Multi-Control Display Unit (MCDU) that includes a display and a keypad or other input device) associated with the computer display; the AOC data engine may also be configured such that the CMU allows the pilot to add his/her commentary to the forwarded information either by selecting from a menu or by entering the commentary by typing or voice. Furthermore, an airline can configure the AOC data engine such that the CMU 18 performs an action, e.g., notifies the pilot, ATC 10, or the aircraft operations center 12, upon occurrence of a "triggering" event, e.g., the aircraft altitude drifts out of a specified range. But, as described below, the CMU 18 can be configured to perform an action only relative to data to which the CMU has access.

The CMU 18 includes an Aircraft Communications Addressing and Reporting System (ACARS) router 22 for sending and receiving datalink messages between the aircraft and the ground.

During operation, each of the electronic subsystems 16 broadcasts certain information (hereinafter "data") to the CMU 18 via the ARINC 429 bus (one of the one or more busses 20), and, as described above, the CMU is configured to route at least some of this data to the ATC 10 or to the aircraft operations center 12 via the ACARS router 22. Examples of a subsystem 16 so broadcasting such data to the CMU 18 via the ARINC 429 bus 20 include an FMS broadcasting the current altitude and the current airspeed of the aircraft 14 periodically (e.g., every one second), and broadcasting, upon the aircraft arriving at a waypoint along the aircraft's flight path, the current time, the elapsed time and the distance the aircraft traveled since the aircraft was at the immediately previous waypoint, and the current airspeed of the aircraft.

Furthermore, the ground-based aircraft operation center 12 is configured to request and to receive, from each of at least one of the electronic subsystems 16, other data that the electronic subsystem does not periodically broadcast over the ARINC 429 bus 20. Examples of such non-broadcast data include but not limited, the current flight plan stored in the FMS for the aircraft 14.

In more detail, to request non-broadcast data from a target one of the electronic subsystems 16, the ground-based aircraft operations center 12 generates a data-request message that identifies the target electronic subsystem and that has an ACARS-compatible format, and sends the data-request message to the ACARS router 22. For example, the data-request message includes an identifier (e.g., an address) of the target electronic subsystem 16, and includes an address, or other description, of the requested data.

In response to the data-request message from the ground-based aircraft operations center 12, the CMU 32 generates, and sends to the service provider for the ground-based aircraft operations center, an acknowledgement of having received the data-request message. The service provider may, or may not, pass the acknowledgement to the ground-based aircraft operations center 12.

The ACARS router 22 routes the data-request message from the ground-based aircraft operations center 12 to the identified target electronic subsystem 16 via the ARINC 429 bus 20. Alternatively, the ACARS router 22 drives the data-request message onto the ARINC 429 bus 20, and the target electronic subsystem 16 intercepts the data-request message in response to an identifier (e.g., an address of the target electronic system) contained within the data-request message.

The target electronic subsystem 16 responds to the received data-request message by processing, generating, or retrieving the requested data, by generating an ACARS-compatible data-response message that includes a payload with the requested data and that includes the requested destination, and by sending the data-response message to the ACARS router 22 via the ARINC 429 bus 20.

The ACARS router 22 routes the data-response message to the ground-based aircraft operations center 12 via the ground service provider (not shown), and the ground-based aircraft operation center extracts the data from the data-response message and consumes the data in any suitable manner.

Assume, for purpose of example, that an FMS of the subsystems 16 is configured to publish, on the ARINC 429 bus 20, the altitude of the aircraft 10 at two-second intervals, but is not configured to publish, on the ARINC 429 bus, flight-plan data that represents the flight plan that is stored in, implemented (while the aircraft 30 is on autopilot) by, and updated by, the FMS.

Therefore, if the flight plan is changed in midflight (e.g., the pilot requests permission to fly above or around turbulence, and ATC 10 grants the request), then the CMU AOC 18 cannot be configured, and, therefore, is unable, to inform, automatically, the ground-based aircraft operations center 12 of the change in the flight plan in a timely manner because the FMS 16 does not publish all of the flight-plan data on the ARINC 429 bus 20, and, therefore, because the CMU does not have full access to the flight-plan data.

Because the ground-based aircraft operations center 12 does not "know" of the change in the flight plan, the ground-based aircraft operations center cannot, and does not, update the flight-plan information. For example, if the change in the flight plan is likely to result in the aircraft 14 arriving early at the destination airport, consequences of the ground-based aircraft operations center 12 not updating the flight-arrival information include the destination airport not having a gate prepared to receive the aircraft when the aircraft lands, and pre-scheduled transportation for a passenger of the aircraft not arriving at the airport in time to pick up the passenger upon his/her arrival at the destination airport. And if the change in the flight plan is likely to result in the aircraft arriving late at the destination airport, consequences of the ground-based aircraft operations center 12 not updating the flight-arrival information include tying up an airport gate for longer than necessary.

A potential solution to the problem of the CMU 18 being unable to provide the ground-based aircraft operations center 12 with particular information from an electronic subsystem 16 onboard the aircraft 14 is to modify the subsystem to broadcast the particular information on the ARINC 429 bus 20 at periodic intervals, or upon the occurrence of an event (e.g., the aircraft 14 reaching a particular altitude, reaching a particular distance from the airport of arrival, or reaching a particular waypoint along the aircraft's flight path).

But unfortunately, this potential solution may be relatively expensive and time consuming, and may nullify any competitive advantage that it might otherwise render to an airline. A modification to an electronic subsystem 16, such as an FMS, often requires the agreement of the aircraft manufacturer and of government bodies overseeing air travel (e.g., the Federal Aviation Administration (FAA) in the United States), and obtaining such agreement can be lengthy and expensive. Furthermore, a so-modified electronic subsystem 16 is subject to a lengthy, expensive, and rigorous re-certification process before it can be placed into service onboard aircraft. Moreover, even assuming that such a modification developed, and provided to an airline, by an avionics manufacturer, is approved and implemented, the modified electronic subsystem 16 might provide no competitive advantage to the airline because other airlines would be able to obtain the modified subsystem from the developing avionics manufacturer or from another subsystem manufacturer.

Another potential solution to the problem of the CMU 18 being unable to provide the ground-based aircraft operations center 12 with particular information from an electronic subsystem 16 onboard the aircraft 14 is to configure a computer circuit of the ground-based aircraft operations center to request (e.g., periodically or upon occurrence of an event) the unpublished data (e.g., the flight-plan data) from the electronic subsystem 16 (e.g., the FMS) by sending a data-request message to the target electronic subsystem via the ACARS router 22.

But unfortunately, this potential solution may be relatively expensive because it may consume a significant amount of the bandwidth of the air-to/from-ground communication links and may consume a significant amount of the processing throughput of the ground-based aircraft-operations-center's computer(s). Typically, an airline pays a fee for each ACARS message (or for each ACARS message over a threshold number per billing period) that the ground-based aircraft operations center 12 sends to, or receives from, the aircraft 14. Therefore, configuring the ground-based aircraft operations center 12 to request, periodically, unpublished data from a target electronic subsystem 16 onboard the aircraft 14 can cause the airline to incur significant messaging fees, plus the air/ground subnetwork may not support all the extra data communications traffic. Furthermore, configuring the ground-based aircraft operations center 12 to request, periodically, unpublished data from one or more target electronic subsystems 16 onboard one or more aircraft 14 can increase, significantly, the messaging load, and thus the overall processing load, of the computer circuit(s) of the ground-based aircraft operations center.

Furthermore, a similar lack-of-data problem may plague systems and subsystems other than the aircraft operations center 12.

For example, a pilot of the aircraft 30 may wish to inform the aircraft operations center 12 when the aircraft reaches the altitude peak of its ascent (or the pilot may wish to inform ATC 10 when the aircraft reaches the altitude peak of its ascent if the ATC does not otherwise have access to this information). But if the data needed to determine when the aircraft 14 reaches the peak of its ascent is not published on the one or more busses 20 (including, e.g., an ARINC 429 bus), and, therefore, is unavailable to the CMU 18, then the pilot cannot so inform the aircraft operations center 12 (or ATC 10). And unlike the aircraft operations center 12, which may be able to request data not published on the one or more busses 20, there is no way for the pilot or CMU 18 to request, from the other electronic subsystems 16, data that the electronic subsystems do not publish on the one or more busses 20.

Other examples of situations in which lack of published data may prevent the occurrence of a desired operation include the lack of published data preventing the CMU 18, or other onboard system or subsystem, from predicting, in real time, the fuel burn and the fuel reserve for the aircraft 14 at various points along the flight path, and from notifying the pilot of the occurrence of an event such as when the aircraft 14 reaches a certain distance (e.g., twenty miles) from the airport of arrival.

Therefore, a need has arisen for a technique for obtaining unpublished data from an electronic subsystem 16 onboard a vehicle, such as the aircraft 14, without the time, cost, loss of competitive advantage, and other complexities associated with modifying the electronic subsystem, and without significantly increasing the processing load of the computer circuit(s) of a communications center such as the ground-based aircraft operations center 12 and without significant air/ground bandwidth utilizing.

An embodiment of a communication management unit (CMU) that can meet this need includes an emulator circuit and a data-mining circuit. The emulator circuit is configured to generate a data request having a same format as a data request from a vehicle operations center or other communications center, to send the data request to a subsystem disposed on a vehicle, and to receive data sent by the subsystem in response to the data request. And the data-mining circuit is configured to provide at least some of the received data to a determining circuit configured to determine information in response to the provided data.

For example, such a CMU can request flight-plan data from a flight management system (FMS) by sending, to the FMS, an emulated data-request message having the same or similar format as a data-request message that the ground-based aircraft operations center 12 is configured to send to the FMS. That is, the CMU is configured to "fool" the FMS into "thinking" that the data-request message originated from the ground-based aircraft operations center 12.

Because the emulated data-request message has the same, or a similar, format as a data-request message from the ground-based aircraft operations center 12 would have, the FMS responds to the emulated data-request message with a data-response message just as the FMS would have responded to a data-request message from the ground-based aircraft operations center.

The CMU intercepts and mines data from the data-response message, and provides the mined data to a determiner circuit, which determines one or more pieces of information (e.g., estimated flight arrival time) from the mined data. "Intercept" means that the CMU receives and acknowledges receipt of the data-response message if required, and that the ACARS router 22 does not transmit the data-response message to the ground-based aircraft operations center 12. Furthermore, "mining" data means that the CMU may extract and send to the determiner circuit only the portion of the data in the data-response message used by the determiner circuit to determine a particular piece of information. For example, if the data-response message from the FMS 16 includes all of the flight-plan data, then the CMU 18 may extract, from the data-response message, only the portion of the flight-plan data that the determiner circuit uses to estimate the arrival time of the aircraft 14 at the destination airport. Furthermore, the determiner circuit can be part of the CMU 18, can be separate from the CMU but still be onboard the aircraft 14, or can be separate from the CMU and remote from the aircraft (e.g., can be part of the ground-based aircraft operations center 12).

Because one can modify a CMU to operate as described above by modifying software or firmware, and not hardware, modifying the CMU is often less time consuming, less costly, and has less-stringent certification requirements, than modifying the hardware of an electronic subsystem 16 or of the ARINC 429 bus 20.

Furthermore, a CMU so modified and configured does not increase the messaging load, or overall processing load, of the ground-based aircraft operations center 12.

Moreover, because an airline typically "owns" the CMU configuration, the above-described modifications that an airline makes to the CMU can be proprietary to the airline. That is, to modify the CMU, the airline does not need the permission of the aircraft manufacturer or of a subsystem manufacturer, and, therefore, does not need to make the modification available to competing airlines.

DETAILED DESCRIPTION

Unless otherwise noted, a value, quantity, or attribute herein preceded by "substantially," "approximately," "about," a form or derivative thereof, or a similar term, encompasses a range that includes the value, quantity, or attribute ±20% of the value, quantity, or attribute, and a range of values preceded by such a term includes the range extended by ±20% of the difference between the range endpoints. For example, an "approximate" range of b to c is a range of $b-20\%\cdot(c-b)$ to $c+20\%\cdot(c-b)$. Furthermore, the terms "a," "an," and "the" can indicate one or more than one of the objects that they modify.

Figure 1:
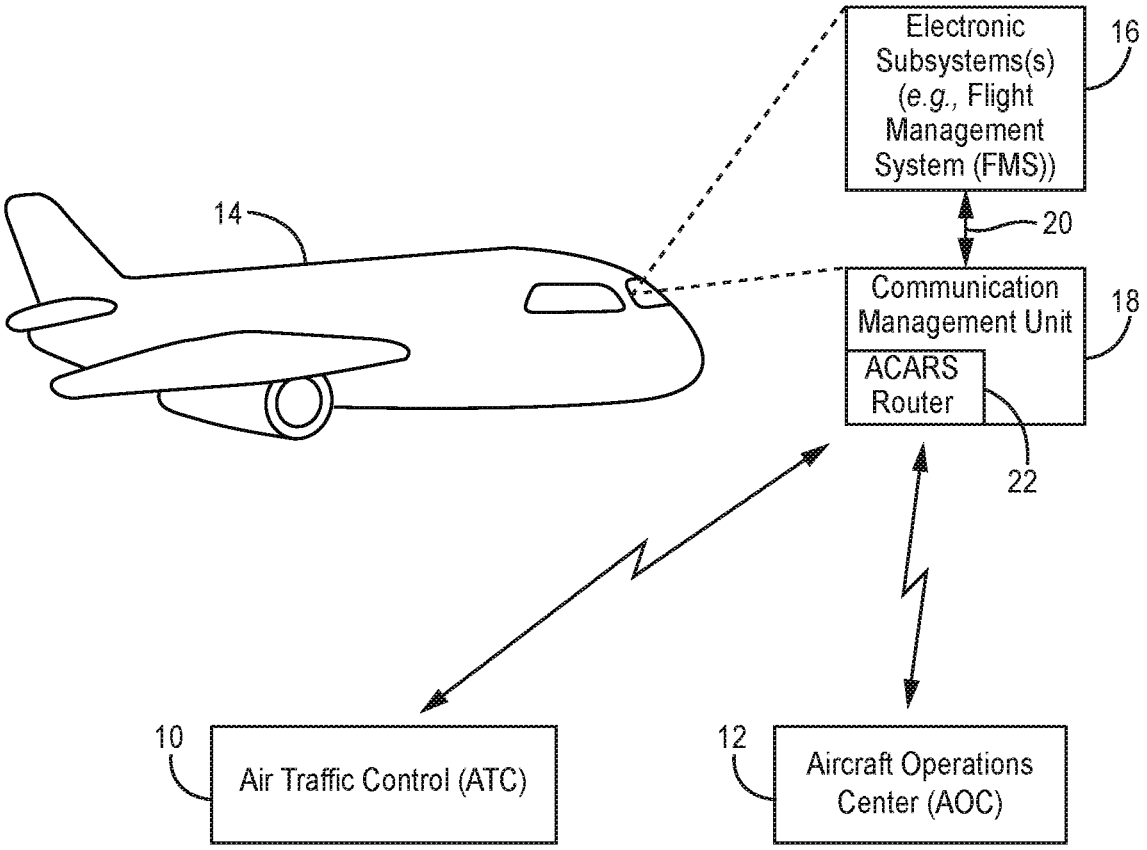
FIG. 1 is diagram of ground-based air traffic control (ATC), a ground-based aircraft operations center, an aircraft in flight, and a communications management unit (CMU) onboard the aircraft and configured for communication with the ATC, the ground-based aircraft operations center, and one or more electronic subsystems onboard the aircraft.
Figure 2:
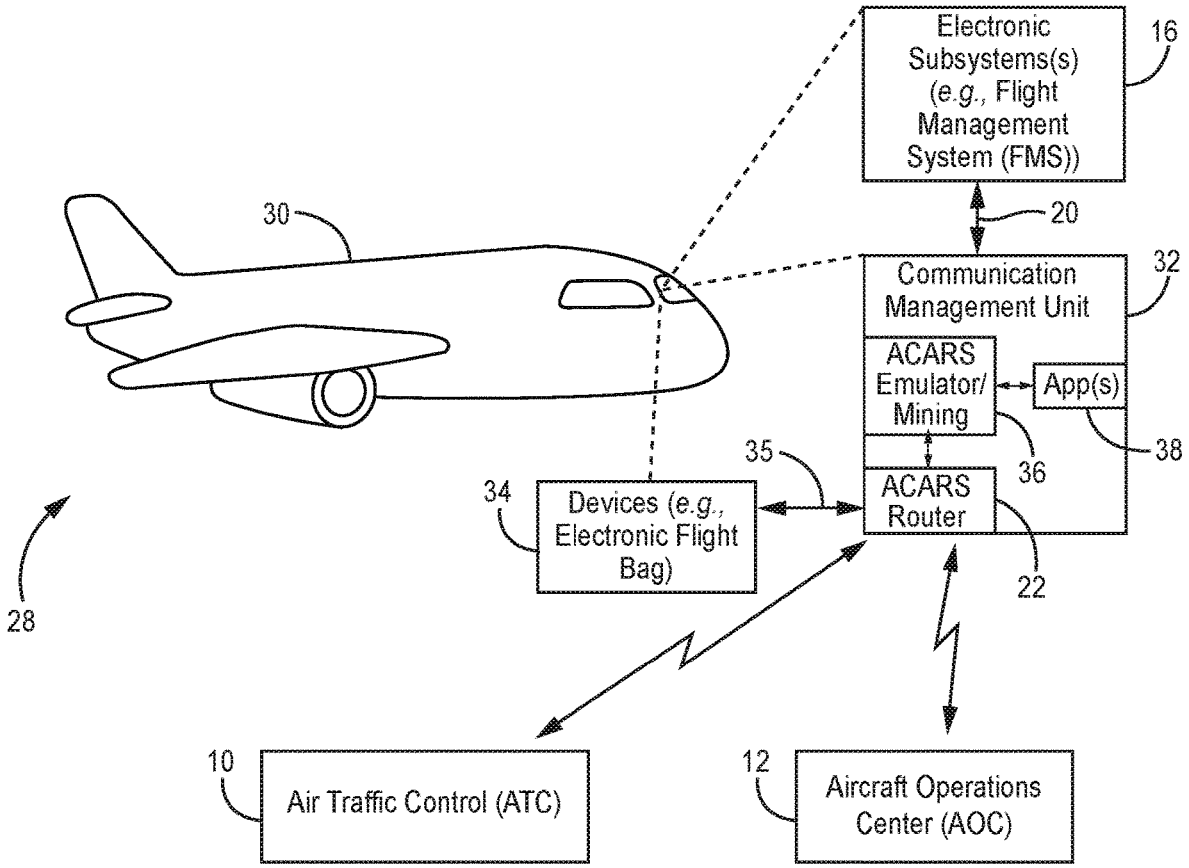
FIG. 2 is diagram of ground-based air traffic control (ATC), a ground-based aircraft operations center, an aircraft in flight, and a communications management unit (CMU) onboard the aircraft, configured for communication with ATC, the ground-based aircraft operations center, and one or more electronic subsystems and electronic devices onboard the aircraft, and modified relative to the CMU of FIG. 1 according to an embodiment.

FIG. 2 is a diagram of a system 28, which includes an aircraft 30, air traffic control (ATC) 10, and an aircraft operations center 12 (e.g., ground based), according to an embodiment in which like numbers reference components common to FIGS. 1 and 2. A difference between the aircraft 30 of FIG. 2 and the aircraft 14 of FIG. 1 is that the aircraft 30 includes a communications management unit (CMU) 32, which is configured to emulate a data request from the ground-based aircraft operations center 12 to obtain, from one or more of the electronic subsystems 16, data that is not published onto the ARINC 429 bus 20 by the one or more subsystems. Furthermore, units and electronic subsystems 16, such as the CMU 32, and other components of the aircraft 30 and the functions of the components, described herein are each implemented by a respective circuit, or by common circuitry such as a microprocessor or microcontroller. Such circuits and common circuitry can be hard-wired, or configured with software or firmware.

In addition to the electronic subsystems 16 and the CMU 32, the aircraft 30 includes one or more electronic devices 34, such as electronic-flight-bag (EFB) devices, cabin terminal, or maintenance terminal or personal electronic device, at least some of which are, or can be, configured for communication with the CMU 32. For example, a device 34 can be a laptop or tablet computer or personal electronic device (PED) configured to display a flight path of the aircraft 30, to receive flight-plan data from a flight management system (FMS) 16 via the CMU 32, and to update the flight-path display in response to the flight-plan data. Although shown coupled to the CMU 32 via a bus 35, one or more of the electronic devices 34 can be coupled to the CMU 32 by the ARINC 429 bus 20 or by other coupling means such as an airplane interface device (AID), examples of which include Ethernet, ARINC 429, ARINC 629, RS 232, and a wireless channel).

And in addition to the ACARS router 22, the CMU 32 includes an ACARS emulator-and-data-mining circuit 36 and one or more software applications 38.

The ACARS emulator-and-data-mining circuit 36 is configured to generate an emulated data-request message that has the same, or a similar, format as a data-request message generated by the ground-based aircraft operations center 12, such that a target one of the electronic subsystems 16 is configured to respond to the emulated data-request message just as the target subsystem would respond to a data-request message from the ground-based aircraft operations center.

The ACARS emulator-and-data-mining circuit 36 is further configured to send the emulated data-request message to a target electronic subsystem 16 via the ARINC 429 bus 20 or another channel (not shown in FIG. 2), and to intercept a downlink response message that the target electronic subsystem 16 returns in response to an emulated data-request message.

The ACARS emulator-and-data-mining circuit 36 is still further configured to mine data from the downlink response message received from the target electronic subsystem 16, and to provide the mined data to one or more of the devices 34, the applications 38, and the ground-based aircraft operations center 12, for determining information (e.g., predicted fuel consumption, predicted flight arrival time) from the provided data.

Still referring to FIG. 2, operation of the system 28 is described according to an embodiment in which the CMU 32 obtains unpublished flight-plan data and provides the obtained data to the ground-based aircraft operations center 12, and in which a computing circuit of the ground-based aircraft operations center updates an estimated arrival time of the aircraft 30 at a destination airport in response to the provided flight-plan data. It is understood that the operation of the system 28 would be similar in an embodiment in which the CMU 32 obtains unpublished data from any other of the electronic subsystems 16 and provides the obtained data to any other of the destinations such as one or more of the electronic devices 34 and one or more of the software applications 38.

The CMU 32 causes the ACARS emulator-and-data-mining circuit 36 to request, periodically (e.g., every ten seconds to five minutes, for which the period can be configured through an aircraft database such as the data base 50 of FIG. 3), unpublished flight-plan data from the FMS electronic subsystem 16 (hereinafter "FMS 16"). For purposes of this example, "unpublished flight-plan data" is flight-plan data that the FMS is not configured to publish, automatically, on the ARINC 429 bus 20.

For each request, the ACARS circuit 36 generates an emulated data-request message that includes an address, or other identity, of the FMS 16, that specifies the data requested (e.g., all flight-plan data, partial flight-plan data), and that has a format sufficiently similar to the format that a comparable data-request message from the ground-based aircraft operations center 12 would have so that the FMS will respond to the emulated data-request message as it would to an actual data-request message from the ground-based aircraft operations center.

Next, the ACARS circuit 36 sends the emulated data-request message to the FMS 16 via the ARINC 429 bus 20, or via any other suitable communication channel (e.g., a WiFi® channel, a BlueTooth® channel).

The FMS 16 receives the emulated data-request message, generates, in response to the emulated data-request message, a downlink data-response message having a payload that includes the requested flight-plan data, and sends the data-response message to the ACARS emulator-and-data-mining circuit 36 via the ARINC 429 bus 20 or any other suitable communication channel. If the requested data is not yet available, then the FMS 16 generates the data, or waits until the requested data otherwise is generated. Furthermore, the data-response message may include an identifier, such as the address or other destination code, of the message destination, which, in this example, is the ACARS circuit 36. Alternatively, the CMU 32 parses the data-response message from the FMS 16 to determine whether the data-response message is destined for the CMU (i.e., is the response to a corresponding previously emulated data request) or for the ground-based aircraft operations center 12.

The ACARS emulator-and-data-mining circuit 36 receives the data-response message, and optionally mines the payload for the portion of the data to be used by the ground-based aircraft operations center 12 computer system. For example, if the emulated data-request message requests all flight-plan data, but the ground-based aircraft operations center 12 computer system needs only the airspeed and heading of the aircraft 30, then the ACARS circuit mines, or extracts, only the airspeed and heading from the flight-plan data. Alternatively, the ACARS circuit 36 can provide all of the data in the data-response message to the ground-based aircraft operations center 12, which has the option of using only some of the provided data.

If the data-response message is the first such message generated for the ground-based aircraft operations center 12 on the current flight of the aircraft 30, then the ACARS circuit 36 provides the selected portion of the flight-plan data to the ground-based aircraft operations center, where, as stated above, the selected portion can be some or all of the flight-plan data.

If, however, the data-acknowledge message is the second or subsequent such message generated for the ground-based aircraft operations center 12 on the current flight of the aircraft 30, then one of the software applications 38 determines, in a conventional manner, whether the latest version of the selected portion of the data differs from the previous version of the same data. For example, the one of the software applications 38 compares the current version of the data to the immediately previous version of the data to determine if the current version is the same as, or is different than, the immediately previous version.

If the one of the applications 38 determines that there is no difference between the latest and previous versions of the data, then the CMU 32 does not send the selected data portion to the ground-based aircraft operations center 12, and waits until the ACARS circuit 36 sends a subsequent data-request message to the FMS 16. By not sending redundant data, the CMU 32 saves bandwidth over the ACARS communication channel and the cost of sending an ACARS message, and relieves the ground-based aircraft operations center 12 of the burden of needlessly processing redundant data.

But if there is a difference between the latest and previous versions of the data, then the ACARS circuit 36 provides the latest version of the selected portion of the flight-plan data to the ground-based aircraft operations center 12.

Next, a computing circuit of the ground-based aircraft operations center 12 determines, in response to the latest version of the selected portion of the flight-plan data, a new estimated arrival time of the aircraft 30 at the destination airport, and updates the arrival time that a monitor at the destination airport displays.

In another example, each of one or more of the processing devices (e.g., computing circuit of the ground-based aircraft operations center 12, devices 34, computing circuit(s) running the applications 38) uses a respective portion of the flight-plan data from the data-response message from the FMS 16.

In such an embodiment, the ACARS circuit 36 mines different portions of the flight-plan data for the different processing devices, and sends, to each processing device, only the portion of the flight-plan data that the processing device will consume.

For example, assume that one of applications 38 predicts fuel consumption of the aircraft 30, a tablet computer device 34 predicts and displays a flight path of the aircraft, and a computing circuit of the ground-based aircraft operations center 12 predicts the arrival time of the aircraft at a destination airport.

The ACARS circuit 36 generates, and sends to the FMS 18 via the ARINC 429 bus 20, a data-request message that requests all of the flight-plan data.

The ACARS circuit 36 then mines respective portions of the flight-plan data from the payload of the data-response message, and provides the selected data portions to the respective processing devices. For example, the ACARS circuit 36 mines, from the payload of the data-response message, the portion of the flight-plan data that the application 38 uses to predict the fuel consumption of the aircraft 30, and provides only this portion of the data to the application. Similarly, the ACARS circuit 36 mines, from the payload of the data-response message, the portion of the flight-plan data that the tablet computer device 34 uses to predict the flight path of the aircraft 30, and provides only this portion of the data to the tablet. And, the ACARS circuit 36 mines, from the payload of the data-response message, the portion of the flight-plan data that a computing circuit of the ground-based aircraft operations center 12 uses to predict the arrival time of the aircraft 30, and provides only this portion of the data to the ground-based aircraft operations center 12.

Still referring to FIG. 2, alternate embodiments of the system 28 are contemplated. For example, the ACARS emulator-and-data-mining circuit 36 can be configured to generate emulated data-request messages for subsystems 16 other than the FMS. Moreover, the CMU 32, or another similar circuit, can be disposed on a vehicle (e.g., self-driving automobile, spacecraft, watercraft, drone) other than an aircraft. In addition, alternate embodiments described below in conjunction with FIGS. 3-4 may be applicable to the system 28 of FIG. 2.

Figure 3:
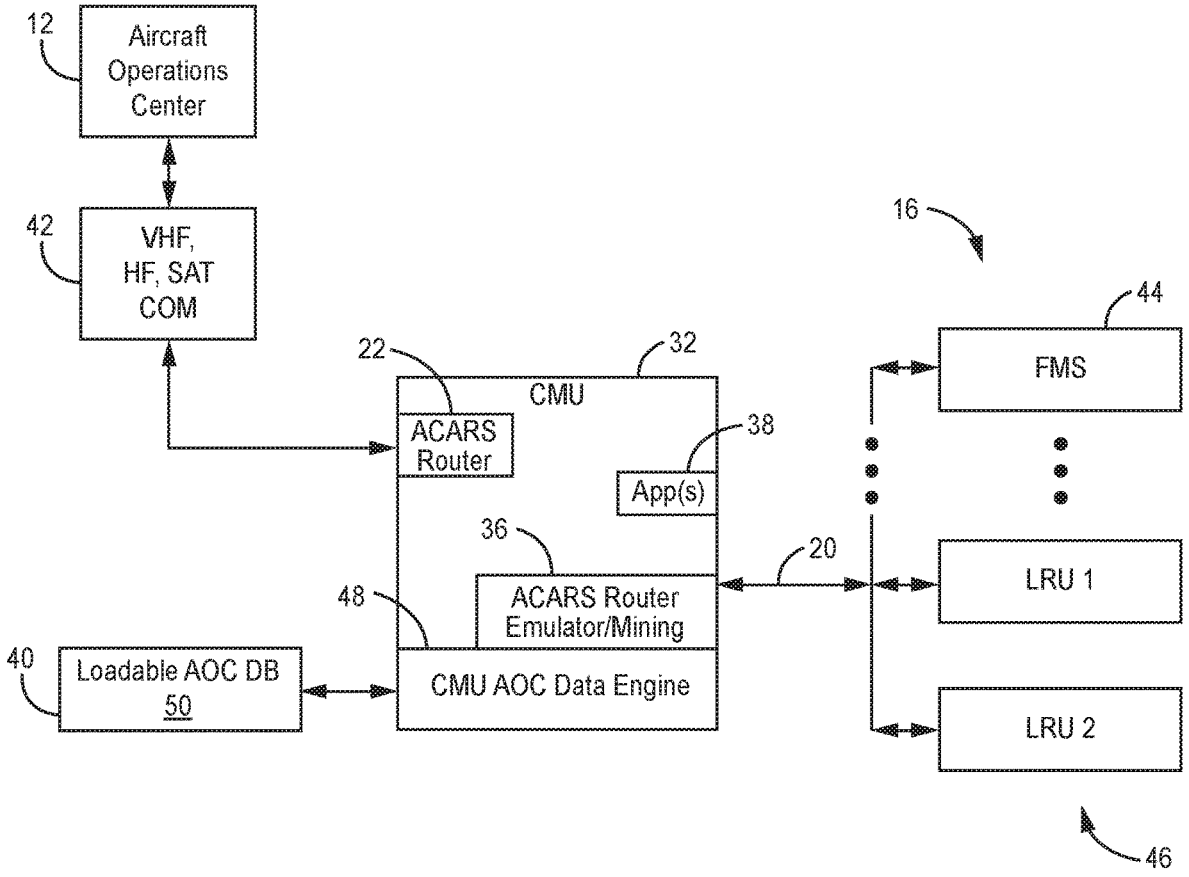
FIG. 3 is a diagram of the communications management unit (CMU), the electronic subsystems, and the electronic devices onboard the aircraft of FIG. 2, and of the ground-based aircraft operations center of FIG. 2, according to an embodiment.

FIG. 3 is a diagram of the ground-based aircraft operations center 12, electronic subsystems 16, the CMU 32, a memory 40, and a communication link 42, according to an embodiment in which like numbers reference components common to FIGS. 1-3.

In addition to a flight management system (FMS) 44, the electronic subsystems 16 include one or more Line Replaceable Units (LRUs) 46, which may include the electronic devices 34 (e.g., a tablet computer and other electronic-flight-bag devices) of FIG. 2. Furthermore, because they are coupled to the ARINC 429 bus 20, the CMU 32 and the FMS 44 can be considered as two of the LRUs 46.

In addition to the ACARS router 22, the ACARS router-emulator-and-mining circuit 36, and the one or more software applications 38, the CMU 32 includes an aircraft-operations-communications (AOC) data engine 48, which is configured to control, and possibly to include, the ACARS circuit, the ACARS router, and one or more of the applications 38, and otherwise to cause the CMU to request unpublished data from one or more of the electronic subsystems 16, to mine the received unpublished data, and to provide the unpublished data to the ground-based aircraft operations center 12 (or possibly to one or more other devices), as described above in conjunction with FIG. 2. For example, the Aircraft Operations Communications (AOC) data engine 48 is implemented by a computing circuit that executes software or firmware.

The memory 40 stores an aircraft-operations-center (AOC) database 50, which defines the functions performable by the AOC data engine 48, and which a computing circuit uses to build the data engine 48 during a boot routine. Alternatively, other ways to build, actually or effectively, the data engine 48 include using modified non-certifiable software run by the CMU 32 to build the data engine, or by updating an aircraft program module (APM, not shown in FIG. 3), which is non-certifiable dongle-like device coupled to the CMU and which could function as the data engine or for source for the data engine database (a "non-certifiable" item means that there is no certification requirement for the item). Therefore, to configure the AOC data engine 48, and, therefore, to configure the CMU 32, to operate as described above in conjunction with FIG. 2, a designer need only update the database 50 (or, optionally, the non-certifiable CMU software or the aircraft program module). Updating the database 50 (or the non-certifiable CMU software, the aircraft program module) is typically less costly, less time consuming, and less complex than updating one or more of the subsystems 16 or updating the hardware that forms the CMU 32, and does not require as rigorous of a re-certification process as an update of a subsystem 16 often requires; furthermore, the database 50 (and the non-certifiable CMU software, the aircraft program module), and its updates, can be proprietary to an aircraft or operator. Moreover, the memory 40 can be any suitable type of volatile or non-volatile memory, such as random access memory (RAM), static RAM (SRAM), dynamic RAM (DRAM), and electrically erasable and programmable memory (EEPROM).

The communications link 42 is configured to transfer messages between the ACARS router 22 and the ground-based aircraft operations center 12, and between the ACARS router and the ATC 10 (not shown in FIG. 3). The communication link 42 can be any circuitry, device, or apparatus suitable for transferring messages, such as, for example, a satellite communication link, a High Frequency (HF) link, or a Very High Frequency (VHF) link.

Still referring to FIG. 3, in operation during a boot routine for the CMU 32, a computing circuit, such as a microprocessor or microcontroller, builds and instantiates the AOC data engine 48, and possibly the entire CMU, in response to the AOC database 50 (or the non-certifiable CMU software, the aircraft program module) stored in the memory 40.

After the computing circuit builds and instantiates the AOC data engine 48 and the other portions of the CMU 32, the CMU operates as described above in conjunction with FIG. 2.

Still referring to FIG. 3, alternate embodiments of the CMU 32, and the procedure for building and instantiating the AOC data engine 48 and the CMU, are contemplated. For example, a computing circuit can build and instantiate a CMU similar to the CMU 32, and a data engine similar to the data engine 48, on a vehicle (e.g., self-driving automobile, spacecraft, watercraft, drone) other than an aircraft. In addition, alternate embodiments described above in conjunction with FIG. 2 and below in conjunction with FIG. 4 may be applicable to the CMU 32 and the AOC data engine 48.

Figure 4:
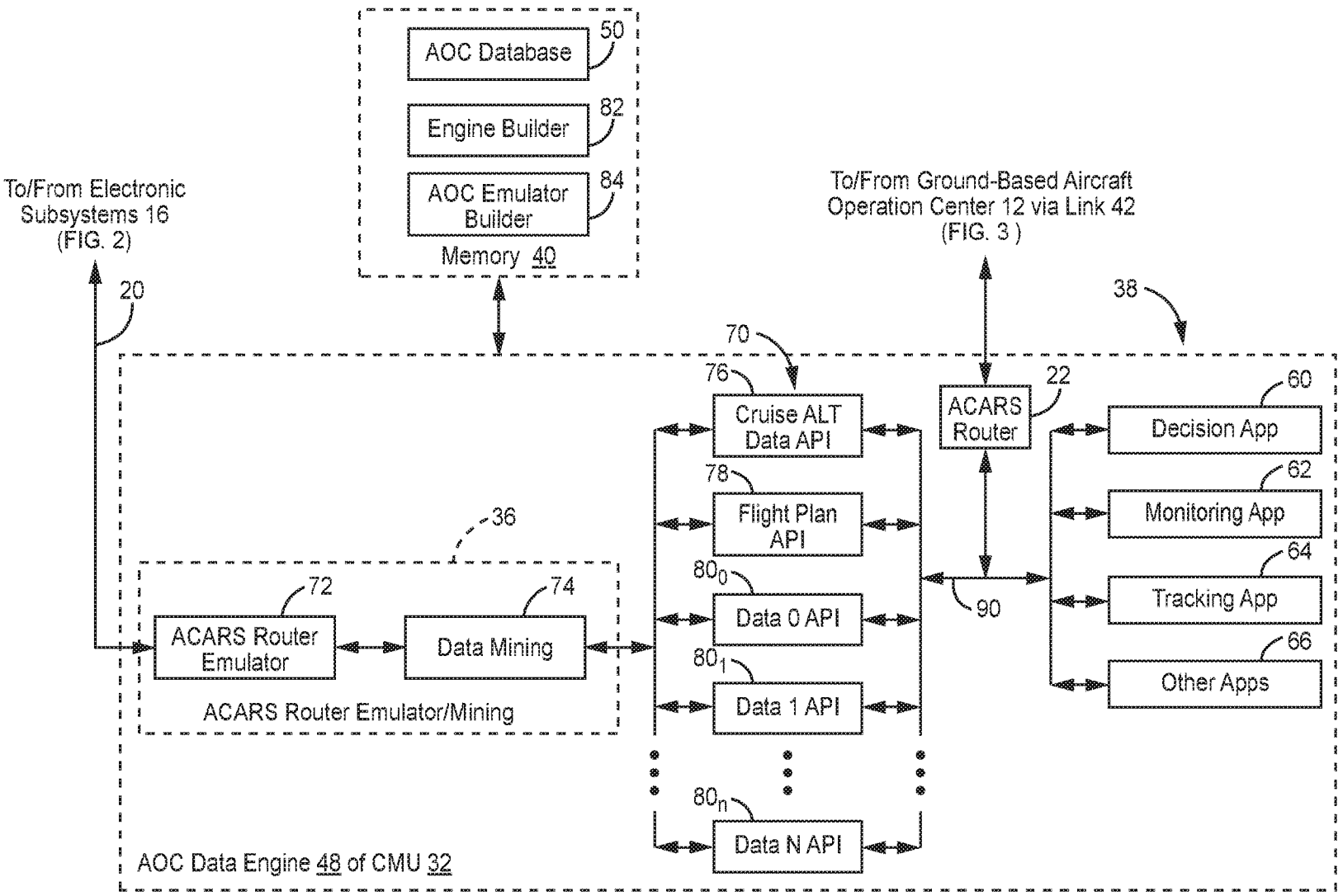
FIG. 4 is a diagram of the CMU of FIGS. 2-3, a memory that stores the CMU builder(s), and the electronic devices of FIGS. 2-3, according to an embodiment.

FIG. 4 is a more detailed diagram of the AOC data engine 48 of the CMU 32 and the memory 40 of FIG. 3, according to an embodiment in which like numbers reference components common to FIGS. 1-4.

The software applications 38 instantiated on a computing circuit that forms the CMU 32 include a decision application 60, a monitoring application 62, a tracking application 64, and one or more other applications 66. The applications 38 can be executed by separate computing circuits, or two or more of the applications can be executed by a same computing circuit. Furthermore, each of the applications 38 are configured to operate not only on unpublished and mined data provided by the ACARS circuit 36, but are also configured to operate on data provided by another one or more of the applications. Moreover, one or more of the software applications 38 can be omitted from the AOC data engine 48, and the AOC data engine 48 can be configured to perform respective functions of each of the one or more omitted software applications.

The decision application 60 is configured to make decisions in response to unpublished data that the ACARS circuit 36 requests and receives from one or more of the electronic subsystems 16 and provides to the decision application. For example, the decision application 60 is configured to notify a pilot to request a change in course based on a comparison of current fuel level provided by a fuel sensor (not shown in FIG. 4) versus the amount of fuel that the decision application predicts the aircraft 30 (FIG. 2) will consume in traveling to its destination airport.

The monitoring application 62 is configured to monitor flight- and aircraft-related parameters (e.g. to monitor the flight plan for changes, fuel level, altitude, airspeed to detect a stall) in response to data that the ACARS circuit 36 requests and receives from one or more of the electronic subsystems 16 and provides to the monitoring application.

The tracking application 64 is configured to track the actual flight path already traversed by the aircraft 30 (FIG. 2), and to predict the flight path to be traversed by the aircraft, in response to data that the ACARS circuit 36 requests and receives from one or more of the electronic subsystems 16 and provides to the tracking application.

And examples of other applications 66 include an application that is configured to determine a best course adjustment in response to a request from a pilot to alter the course of the aircraft 30 (FIG. 2), for example, to circumvent bad weather or turbulence.

The ACARS circuit 36 includes an ACARS router emulator 72 and a data-mining circuit 74. The router emulator 72 is configured to generate emulated data-request messages, and to receive datalink response messages that the electronic subsystems 16 send in response to the emulated data-request messages, as described above in conjunction with FIG. 2. And the data-mining circuit 74 is configured to mine data from the payloads of the datalink response messages received by the ACARS emulator 72. For example, on boot up, the data-mining circuit 74 can be configured, by the AOC database 50 and the engine builder 82, to mine data requested by one of more of the applications 38.

In addition to the ACARS router 22, the ACARS router-emulator-and-data-mining circuit 36, and the one or more applications 38, the CMU 32 includes one or more application interfaces 70.

Each of the one or more application interfaces 70 is configured to generate messages that include mined data from the data-mining circuit 74, or otherwise to package the mined data, so that the mined data is in form that is compatible with those of the applications 38 and the ground-based aircraft operations center 12 that are configured to receive the mined data. And each of the one or more application interfaces 70 also can be configured to generate messages that include data published on the ARINC 429 bus 20 by one or more electronic subsystems 16. Alternatively, if one or more of the applications 38 are omitted and the AOC data engine 48 performs the functions of the one or more omitted applications, then a corresponding one or more of the application interfaces 70 may be omitted.

A cruise-altitude application interface 76 is configured to format altitude data received from the FMS 44 (FIG. 3) for consumption by one or more of the applications 38 or by the ground-based aircraft operations center 12, and to provide the formatted altitude to the one or more applications or the ground-based aircraft operations center. The application interface 76 receives the altitude data from the FMS 44 via the ARINC 429 bus 20 if the altitude data is published, or via the data-mining circuit 74 if the altitude data is unpublished. For example, the monitoring application 62 is configured to receive the formatted altitude data from the interface 76, to determine, to monitor, and to update, periodically (e.g., once every one second to five minutes), the cruise altitude of the aircraft 30 (FIG. 2) in response to the formatted altitude data, and to send the updated cruise altitude to the ground-based aircraft operations center 12 via the ACARS router 22.

Similarly, a flight plan interface 78 is configured to format flight-plan data received from the FMS 44 (FIG. 3) for consumption by one or more of the applications 38 or by the ground-based aircraft operations center 12, and to provide the formatted flight-plan data to the one or more applications or the ground-based aircraft operations center. The application interface 78 receives the flight-plan data from the FMS 44 via the ARINC 429 bus 20 if the flight-plan data is published, or via the data-mining circuit 74 if the altitude data is unpublished. For example, the tracking application 64 is configured to determine, to monitor, and to predict, periodically (e.g., once every one second to five minutes), the future flight path and estimated flight times (to respective locations along the flight path) of the aircraft 30 (FIG. 3) in response to the formatted flight-plan data, and to send the predicted flight path and estimated flight times to the ground-based aircraft operations center 12 via the ACARS router 22. Further in example, the ground-based aircraft operations center 12 displays, at the destination airport, the predicted flight path and estimated arrival time of the aircraft 30 (FIG. 2).

Alternatively, the flight plan interface 78 is configured to format flight-plan data received from the FMS 44 (FIG. 3) for consumption first by the pilot, and to send the formatted data to the pilot, who reviews, and potentially comments, the data before selectively causing the CMU 32 to forward the data for consumption by one or more of the applications 38 or by the ground-based aircraft operations center 12.

Each of one or more other application interfaces $\mathbf{80}_0$-$\mathbf{80}_n$ are configured to format respective data from or more of the electronic subsystems 16 for consumption by a corresponding application 38, the ground-based aircraft operations center 12, or another application or device not shown in FIG. 4.

And the memory 40 is configured to store the AOC database 50, a data-engine builder 82, and an AOC-emulator builder 84. As described below, a computing circuit executes the builder 82 to build the data engine 48, and executes the builder 84 to build the ACARS router-emulator-data-mining circuit 36. Alternatively, the data-engine builder 82 can include the AOC-emulator builder 84 such that a computing circuit executes the builder 82 to build both the ACARS router-emulator-and-data-mining circuit 36 and the data engine 48.

Still referring to FIG. 4, instantiation of the CMU 32 and subsequent operation of the CMU are described, according to an embodiment in which the CMU 32 requests flight-plan data from the FMS 44 (FIG. 3), determines whether the flight-plan has changed since the last version of the flight-plan data was requested and received, and, upon detecting a change in the flight plan, provides the flight-plan data to the ground-based aircraft operations center 12 and the tracking application 64.

A computing circuit, such as one or more microprocessors or microcontrollers, executes the AOC-emulator builder 84 and the engine builder 82 to instantiate, in a memory (the memory 40 or another memory not shown in FIG. 4), the ACARS router emulator 72 and the data-mining circuit 74, and the rest of the AOC data engine 48, respectively, according to the AOC database 50. As described above, the AOC database 50 defines the configuration of the ACARS router emulator 72, the data-mining circuit 74, and the rest of the AOC data engine 48. Therefore, a designer can change the structure and operation of the CMU 32 by changing the database 50. As described above, changing the database 50 is typically less costly, less time consuming, and overall less complex than changing the hardware of the CMU 32 or changing the hardware, software, or firmware of one or more of the electronic subsystems 16 onboard the aircraft 30 (FIG. 3).

Next, the instantiated CMU 32 causes the ACARS router emulator 72 to generate an emulated data-request message having the same format as a data-request message from the ground-based aircraft operations center 12 would have, and to send the emulated data-request message to the FMS 44 (FIG. 3) via the ARINC 429 bus 20, or via another communication channel (not shown in FIG. 4). The ACARS router emulator 72 also includes, in the data-request message, an address or a destination code of the FMS 44, or drives the address or the destination code of the FMS onto an address portion of the ARINC 429 bus 20 or other communication channel.

Then, the FMS 44 (FIG. 3) receives the emulated data-request from the ACARS router emulator 72.

Next, in response to the received emulated data-request message, the FMS 44 generates a data-response message that includes the requested data. For example, the FMS 44 generates the requested data, or retrieves the requested data from a memory or from another source. If the FMS 44 can provide only some of the requested data, can provide none of the requested data, or can provide only more data than the CMU 32 requested, then the FMS can be configured to provide an error code as part of the data-response message, where the error code identifies the portion of the requested data included in the data-response message, the portion of the data not provided in the data-response message, or a map of the data within the payload of the data-response message. Alternatively, the data-mining circuit 74 may "know," a priori, the data map, which indicates which flight-plan data (e.g., heading, air-speed) is located in which portion of the payload of the data-response message. In this latter case, the FMS 44 need not provide an error code or a data map as part of the data-response message.

Then, the ACARS router emulator 72 intercepts the data-response message from the FMS 44, provides the data in the payload of the data-response message to the data-mining circuit 74, and acknowledges receipt of the data-response message to the FMS 44.

Next, the data-mining circuit 74 identifies and extracts, from the payload of the data-response message from the FMS 44, the portion(s) of the flight-plan data to send to the ground-based aircraft operations center 12, and extracts the portion(s) of the flight-plan data to send to the tracking application 64 (the portion to send to the ground-based aircraft operations center 12 can be the same as, or different from, the portion to send to the tracking application 64).

Then, the data-mining circuit 74 sends the extracted portions of the flight-plan data to the flight-plan application interface 78.

Next, the flight-plan application interface 78 formats, and otherwise conditions, the extracted data portions to be compatible with the tracking application 64 and with the corresponding application being run by the ground-based aircraft operations center 12 computer system, respectively.

Then, the flight-plan application interface 78 sends the formatted, and otherwise conditioned, extracted AOC data portion to the ground-based aircraft operations center 12 via a bus 90 (or other interface) and the ACARS router 22, and sends the formatted, and otherwise conditioned, tracking-application data portion to the tracking application 64 via the bus 90 (or other interface).

Next, the computing circuit of the ground-based aircraft operations center 12 determines information, such as a predicted arrival time or fuel consumption of the aircraft 30 (FIG. 2), from the received portion of the flight-plan data.

Similarly, a computing circuit executing the tracking application 64 determines a predicted flight path of the aircraft 30 (FIG. 2), and displays the predicted flight path on a display screen (not shown in FIG. 4). For example, the display screen may be built into the aircraft 30, or may be on an electronic-flight-bag device such as a tablet computer. For example, the computing circuit executing the tracking application 64 can communicate with such a device wirelessly, such as via a BlueTooth® protocol directly or via an AID, which interfaces to the computing circuit in a wired manner and interfaces to the device in a wireless manner, or the device can be coupled in a wired manner to the ARINC 429 bus 20, to an Ethernet bus, etc.

For subsequent emulated data-request messages to the FMS 44 (FIG. 3) from the CMU 32, the above steps are repeated, except that before the data-mining circuit 74 sends the extracted portions of the flight-plan data to the application interface 78, the data-mining circuit, or another circuit, determines, for each data portion, whether the data in the portion has changed relative to the most recently received prior data portion. If the current data portion has changed relative to the prior data portion, then the data-mining circuit 74 sends the data portion to the application interface 78. But if the current data portion has not changed relative to the prior data portion, then the data-mining circuit 74 does not send the data to the application interface 78. That is, the CMU 32 does not send flight-plan data to the ground-based aircraft operations center 12 or to the tracking application 64 unless the flight-plan data indicates a change in the parameters(s) of the flight plan represented by the respective data portions. Not re-sending the same flight-plan data saves ACARS message charges, and conserves computing resources by relieving the ground-based aircraft operations center 12 and the tracking application 64 of needlessly processing unchanged flight-plan data.

Still referring to FIG. 4, alternate embodiments of the CMU 32, the AOC data engine 48, and the building and instantiation of the AOC data engine and the CMU, are contemplated. For example, a communication-management device similar to the CMU 32 can be included on a vehicle other than an aircraft, where the vehicle includes electronic subsystems and devices such as the subsystems 16 and devices 34 (FIG. 2), and where the vehicle is configured to communicate with a remote communications center such as a remote vehicle operations center; examples of such a vehicle include an automobile (conventional or self-driving), a watercraft, a spacecraft, and a drone or other unmanned vehicle. Furthermore, the ACARS router emulator 72 can be configured to emulate messages from remote systems including the ground-based aircraft operations center 12; examples of such other remote systems include ATC 10 (FIG. 2), operations centers for other vehicles such as automobiles, water vessels, drones, trains, and space craft, networks of communication service providers such as ARINC and SITA, and maintenance centers for aircraft or other vehicles (a maintenance center for aircraft can be part of, or separate from, the ground-based aircraft operations center 12). Moreover, alternate embodiments described above in conjunction with FIGS. 2-3 may be applicable to the CMU 32, and the building and instantiation of the AOC data engine 48, of FIG. 4.

Referring to FIGS. 2-4, other examples of how the CMU 32 can use data received and mined by the ACARS-router-and-emulator-and-data-mining circuit 36 follow.

For example, a pilot of the aircraft 30 may want the CMU 32 to determine the aircraft's fuel-burn rate, to predict the aircraft's fuel reserves at locations along the flight path, and to update the predicted burn rate and fuel reserves periodically during the flight. To enable performance of this determination and prediction, the router-emulator-and-data-mining circuit 36 is configured to request periodically from the FMS 16 via an emulated aircraft-operations-center request, and to mine, data such as windspeed, airspeed, distance to the destination airport, and actual fuel consumption. The circuit 36 periodically provides the mined data to one or more applications 66 configured to calculate the actual fuel burn and to predict fuel reserves at identified locations along the current flight path. The circuit 36, or another circuit of the CMU 32, periodically receives the calculated fuel burn and predicted fuel reserves from the one or more applications, and periodically provides this information, for example, to the pilot via the bus 20 and a cockpit computer display (not shown in FIGS. 2-4). The pilot periodically consumes this information, and, for each instance in which the pilot consumes this information, he/she can cause the ACARS router 22 to forward this information, along with his/her commentary, in an appropriately formatted message to ATC 10 or to the aircraft operations center 12. Alternatively, the AOC data engine 48 can be configured such that it, or another circuit of the CMU 32, automatically notifies the pilot, ATC 10, or the aircraft operations center 12, if predicted fuel reserves fall below a threshold value at any location along the flight path. In this example, it is the ability of the emulator 72 to emulate a data request from the ground-based aircraft operations center 12 to the FMS 16 that allows the CMU 32 to calculate fuel burn and to predict fuel reserves.

In another example, personnel at the aircraft operations center 12 may want the CMU 32 to predict, periodically and automatically, the time when the aircraft 30 will be a particular distance (e.g., 50 miles) from the destination airport, and to notify, automatically, the pilot and the aircraft operations center when the predicted time is ten minutes away. To enable performance of this notification, the router-emulator-and-data-mining circuit 36 is configured to request periodically from the FMS 16 via an emulated aircraft-operations-center request, and to mine, data including current position, airspeed, flight path, and distance along the flight path to the destination airport. The circuit 36 periodically provides the mined data to one or more applications 66 configured to predict the time to the particular distance from the destination airport and to determine when that predicted time is within ten minutes from the current time. The circuit 36, or another circuit of the CMU 32, periodically receives, from the one or more applications 66, an indication as to whether the predicted time to the particular location is within ten minutes of the current time. In response to an indication that the predicted time is ten or few minutes away, the CMU 32 notifies the pilot via the bus 20 and a cockpit computer display (not shown in FIGS. 2-4), generates a notification message, and sends the message to the aircraft operations center 12 via the ACARS router 22. In this example, it is the ability of the emulator 72 to emulate a data request from the ground-based aircraft operations center 12 to the FMS 16 that allows the CMU 32 to get data that is used to notify the pilot and aircraft operations center 12 upon the occurrence of the "triggering" event of the aircraft 30 being within a specified time window from arriving at a particular location.

From the foregoing, it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated. Moreover, the circuit components described above may be disposed on a single or multiple integrated-circuit (IC), a digital signal processor (DSP), a filter and detect (FAD) circuit, integrated-photonic (IP) dies, or radio-frequency-over-glass (RFOG) dies to form one or more ICs/IPs/RFOGs/DSP/FAD, where these one or more ICs/IPs/RFOGs/DSP/FAD may be coupled to one or more other ICs/IPs/RFOGs/DSP/FAD. Furthermore, one or more components of a described apparatus or system may have been omitted from the description for clarity or another reason. Moreover, one or more components of a described apparatus or system that have been included in the description may be omitted from the apparatus or system.

Example Embodiments

What is Exampled is:

Example 1 includes a communication management unit, comprising: an emulator circuit configured to generate a data request having a same format as a data request from a vehicle communications center, to send the data request to a subsystem disposed on a vehicle, and to receive data sent by the subsystem in response to the data request; and a data-mining circuit configured to provide at least some of the received data to a determining circuit configured to determine information in response to the provided data.

Example 2 includes the communication management unit of Example 1 wherein the emulator circuit and the data-mining circuit are disposed on the vehicle.

Example 3 includes the communication management unit of any of Examples 1-2 wherein the determining circuit is disposed on the vehicle.

Example 4 includes the communication management unit of any of Examples 1-3, further comprising the determining circuit.

Example 5 includes the communication management unit of any of Examples 1-4, further comprising a computing circuit that includes the emulator circuit and the data-mining circuit.

Example 6 includes the communication management unit of any of Examples 1-5, further comprising a computing circuit that includes the emulator circuit, the data-mining circuit, and the determining circuit.

Example 7 includes the communication management unit of any of Examples 1-6, wherein the emulator circuit is configured to generate the data request having a format compatible with an aircraft communications addressing and reporting system.

Example 8 includes the communication management unit of any of Examples 1-7, wherein the data-mining circuit is configured to provide to the determining circuit only the portion of the received data in response to which the determining circuit is configured to determine the information.

Example 9 includes a method, comprising: emulating, with a computing circuit onboard a vehicle, a data request from a vehicle communications center that is remote from the vehicle; sending, with the computing circuit, the emulated data request to a subsystem onboard the vehicle via a message route that excludes a vehicle communications center that is remote from the vehicle; receiving, with the computing circuit and via a message route that excludes a vehicle communications center that is remote from the vehicle, data sent by the subsystem in response to the emulated data request; mining the data received from the subsystem; and determining information in response to the mined data.

Example 10 includes the method of Example 9, wherein the emulated data request has a format that is compatible with a format of a data request from a vehicle communications center that is remote from the vehicle.

Example 11 includes the method of any of Examples 9-10, wherein the vehicle includes an aircraft.

Example 12 includes the method of any of Examples 9-11, wherein the one or more vehicle communications centers include one or more ground-based aircraft operations centers.

Example 13 includes the method of any of Examples 9-12, wherein the subsystem includes a flight-management subsystem.

Example 14 includes the method of any of Examples 9-13, wherein determining the information includes determining information related to a path along which the vehicle is traveling.

Example 15 includes the method of any of Examples 9-14, wherein determining the information includes determining information related to the vehicle.

Example 16 includes the method of any of Examples 9-15, wherein the vehicle communications centers each include one or more computer systems.

Example 17 includes the method of any of Examples 9-16, wherein the computing circuit includes a communication-management-unit subsystem.

Example 18 includes a non-transitory computer-readable medium storing instructions that, when executed by one or more computing circuits onboard a vehicle, cause the one or more computing circuits, or one or more other circuits onboard the vehicle and under control of the one or more computing circuits: to emulate a data request from a vehicle communications center that is remote from the vehicle; to send the emulated data request to a subsystem onboard the vehicle via a message route that excludes a vehicle communications center that is remote from the vehicle; to receive, via a message route that excludes a vehicle communications center that is remote from the vehicle, data sent by the subsystem in response to the emulated data request; and to provide at least some of the received data to a determining circuit configured to determine information in response to the provided data.

Example 19 includes the non-transitory computer-readable medium of Example 18, wherein the determining circuit is part of the one or more computing circuits or the one or more other circuits.

Example 20 includes the non-transitory computer-readable medium of Example 19, wherein the determining circuit is separate from the one or more computing circuits and the one or more other circuits.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A communication management unit, comprising:

an emulator circuit configured to generate a data request having a same format as a data request from a vehicle communications center, to send the data request to a subsystem disposed on a vehicle, and to receive data sent by the subsystem in response to the data request; and a data-mining circuit configured to provide at least some of the received data to a determining circuit configured to determine information in response to the provided data, wherein the data-mining circuit is configured to provide to the determining circuit only the portion of the received data in response to which the determining circuit is configured to determine the information.

2. The communication management unit of claim 1 wherein the emulator circuit and the data-mining circuit are disposed on the vehicle.

3. The communication management unit of claim 1 wherein the determining circuit is disposed on the vehicle.

4. The communication management unit of claim 1, further comprising the determining circuit.

5. The communication management unit of claim 1, further comprising a computing circuit that includes the emulator circuit and the data-mining circuit.

6. The communication management unit of claim 1, further comprising a computing circuit that includes the emulator circuit, the data-mining circuit, and the determining circuit.

7. The communication management unit of claim 1 wherein the emulator circuit is configured to generate the data request having a format compatible with an aircraft communications addressing and reporting system.

8. A method, comprising:

emulating, with a computing circuit onboard a vehicle, a data request from a vehicle communications center that is remote from the vehicle;

sending, with the computing circuit, the emulated data request to a subsystem onboard the vehicle via a message route that excludes a vehicle communications center that is remote from the vehicle;

receiving, with the computing circuit and via a message route that excludes a vehicle communications center that is remote from the vehicle, data sent by the subsystem in response to the emulated data request;

mining the data received from the subsystem to determine mined data from the data received from the subsystem; and determining information in response to the mined data, wherein the mined data is only a portion of the data received from the subsystem that is needed to determine the determined information.

9. The method of claim 8 wherein the emulated data request has a format that is compatible with a format of a data request from a vehicle communications center that is remote from the vehicle.

10. The method of claim 8 wherein the vehicle includes an aircraft.

11. The method of claim 8 wherein the one or more vehicle communications centers include one or more ground-based aircraft operations centers.

12. The method of claim 8 wherein the subsystem includes a flight-management subsystem.

13. The method of claim 8 wherein determining the information includes determining information related to a path along which the vehicle is traveling.

14. The method of claim 8 wherein determining the information includes determining information related to the vehicle.

15. The method of claim 8 wherein the vehicle communications centers each include one or more computer systems.

16. The method of claim 8 wherein the computing circuit includes a communication-management-unit subsystem.

17. A non-transitory computer-readable medium storing instructions that, when executed by one or more computing circuits onboard a vehicle, cause the one or more computing circuits, or one or more other circuits onboard the vehicle and under control of the one or more computing circuits:

to emulate a data request from a vehicle communications center that is remote from the vehicle;

to send the emulated data request to a subsystem onboard the vehicle via a message route that excludes a vehicle communications center that is remote from the vehicle;

to receive, via a message route that excludes a vehicle communications center that is remote from the vehicle, data sent by the subsystem in response to the emulated data request; and to provide at least some of the received data to a determining circuit configured to determine information in response to the provided data, wherein the at least some of the received data provided is only a portion of the received data needed by the determining circuit to determine the determined information.

18. The non-transitory computer-readable medium of claim 17 wherein the determining circuit is part of the one or more computing circuits or the one or more other circuits.

19. The non-transitory computer-readable medium of claim 18 wherein the determining circuit is separate from the one or more computing circuits and the one or more other circuits.

* * * * *